US009008551B2

(12) United States Patent
Kurokawa et al.

(10) Patent No.: US 9,008,551 B2
(45) Date of Patent: Apr. 14, 2015

(54) ELECTROPHOTOGRAPHIC PHOTORECEPTOR

(75) Inventors: Keiichi Kurokawa, Matsumoto (JP); Yuji Ogawa, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 0 days.

(21) Appl. No.: 13/577,906

(22) PCT Filed: May 2, 2012

(86) PCT No.: PCT/JP2012/002966

§ 371 (c)(1), (2), (4) Date: Aug. 27, 2012

(87) PCT Pub. No.: WO2013/140467

PCT Pub. Date: Sep. 26, 2013

(65) Prior Publication Data

US 2014/0233983 A1 Aug. 21, 2014

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01)

(58) Field of Classification Search
CPC ..... G03G 15/757
USPC ..... 399/167
See application file for complete search history.

(56) References Cited

U.S. PATENT DOCUMENTS 5,903,803 A 5/1999 Kawai et al.
6,169,866 B1 1/2001 Watanabe et al.
6,173,146 B1 * 1/2001 Wang et al. ..... 399/265
6,324,363 B1 11/2001 Watanabe et al.
6,725,004 B2 * 4/2004 Ahn et al. ..... 399/117
7,813,676 B2 10/2010 Huck et al.
2003/0059233 A1 3/2003 Jang et al.
2007/0140735 A1 6/2007 Karz et al.
2009/0010681 A1 1/2009 Huck et al.

(Continued)

FOREIGN PATENT DOCUMENTS

CN 201174031 Y 12/2008
JP 08-262957 A 10/1996

(Continued)

OTHER PUBLICATIONS

European Search Report dated Dec. 15, 2014.

*Primary Examiner* — WB Perkey
(74) *Attorney, Agent, or Firm* — Rabin & Berdo, P.C.

(57) ABSTRACT

An electrophotographic photoreceptor is removably installed and used in a device main unit of an electrophotography application device so as to form a process cartridge. The device main unit includes a driving-side power transmission portion. The photoreceptor includes a photosensitive drum including a cylindrical conductive base having a photosensitive layer containing a photoconductive material. A flange is fitted to the photosensitive drum. The flange includes a driven-side driving force transmission portion that has a cylindrical member and engaging protrusions. The flange transmits to the photosensitive drum a rotational driving force from the driving-side power transmission portion. A center of the cylindrical member is disposed on a central axis of the photosensitive drum. The protrusions are parallel to the central axis at positions on the outer periphery of the cylindrical member that trisect the cylindrical member. Each protrusion protrudes in a radial direction and engages the driving-side power transmission portion.

20 Claims, 21 Drawing Sheets

(56) References Cited

U.S. PATENT DOCUMENTS

| | | | | |
|---|---|---|---|---|
| 2010/0196047 | A1* | 8/2010 | Jin | 399/111 |
| 2010/0303501 | A1 | 12/2010 | Tsui | |
| 2012/0051787 | A1* | 3/2012 | Lui | 399/167 |
| 2012/0257906 | A1* | 10/2012 | Zhao | 399/111 |
| 2013/0183063 | A1* | 7/2013 | Huck et al. | 399/167 |
| 2014/0133886 | A1* | 5/2014 | Kurokawa et al. | 399/167 |

FOREIGN PATENT DOCUMENTS

| | | | |
|---|---|---|---|
| JP | 08-328449 | A | 12/1996 |
| JP | 2001-324845 | A | 11/2001 |
| JP | 2001-324909 | A | 11/2001 |
| JP | 2003-148503 | A | 5/2003 |
| JP | 2010-144881 | A | 7/2010 |
| WO | WO-2009-000041 | A1 | 12/2008 |

* cited by examiner

B-B CROSS-SECTIONAL VIEW

B-B CROSS-SECTIONAL VIEW

DETAILED VIEW OF A

ELECTROPHOTOGRAPHIC PHOTORECEPTOR

TECHNICAL FIELD

This invention relates to an electrophotographic photoreceptor (hereafter also simply "photoreceptor"), and in particular relates to improvement of a gear flange and flange which, when built into a process cartridge forming an electrophotographic photoreceptor and used, transmits rotational driving force from an electrophotography application device to a photosensitive drum.

BACKGROUND ART

An electrophotographic photoreceptor generally is formed by joining flanges or gear flanges at both ends of a photosensitive drum configured from a conductive base having an outer peripheral face provided with a photosensitive layer. Such a photoreceptor is mounted in a process cartridge, and is further installed into a photocopier, printer, fax machine, or other electrophotography application device for use.

A process cartridge incorporates into an integrated cartridge, disposed close to an electrophotographic photoreceptor, a charging member for directly applying a voltage (including discharging) and various members necessary for development, cleaning, and other electrophotography processes. The cartridge is removably installed in an electrophotography application device, and performs vital functions for image formation.

In an electrophotography application device with a process cartridge installed, first a latent image is formed by optical exposure corresponding to image information of the electrophotographic photoreceptor, which is uniformly charged by a charging process. Next, this latent image is developed using toner in a development process, to form a toner image on the photoreceptor. Then, this toner image is transferred onto paper or another supporting medium by a transfer process, to form an image.

In the prior art, process cartridge methods like that described above have been widely adopted in electrophotography application devices using electrophotography processes. By means of such process cartridges, maintenance of the device main unit is rendered substantially unnecessary, and there is the advantageous result that device maintenance becomes extremely simple.

However, in a process cartridge the electrophotographic photoreceptor executes electrophotography processes by receiving a rotational driving force from the device main unit and rotating. Hence in order to transmit the driving force, a flange or a flange comprising a gear is generally joined to an end portion of the photosensitive drum.

If the gear flange or the flange joined to the photosensitive drum should separate from the photoreceptor, or the joining portion should loosen, a driving force is not transmitted and rotation of the photoreceptor stops, and a major accident such as halting of the device function, or the jitter or other image defects occurs. Hence securing long-term reliability at the portion joining the gear flange or flange to the photosensitive drum such that separation or loosening does not occur is an important technical problem.

On the other hand, in cases where the precision of fit of the driven-side power transmission portion of the flange and the driving-side power transmission portion of the device main unit is poor, problems with transmission of driving force occur, possibly leading to the occurrence of image defects. Hence in addition to securing reliable joining of the flange with the photosensitive drum, it is also important that high rotation precision be maintained over the long term by optimizing the fitting state of the driving-side power transmission portion and reliably transmitting rotational driving force.

To improve the driven-side power transmission portion of the flange, for example Patent Reference 1 discloses a technique wherein a prescribed crooked hole is provided in a device main unit gear, and moreover a twisting protrusion is provided in one end in the length direction of the electrophotographic photoreceptor drum, and that through the fitting of these to transmit a rotational driving force, the rotational precision of the photoreceptor drum is improved.

Further, Patent Reference 2 discloses a technique wherein a device main unit and a process cartridge are respectively provided with a conjoining hole and conjoining protrusion formed on a gear on the device main unit side, and a protruding portion and abutting portion circumscribing same, and wherein by conjoining the device main unit and the process cartridge by means thereof, reliable transmission of driving force and prevention of process cartridge vibration are achieved.

Further, Patent Reference 3 discloses a technique relating to a developing cylinder and driving gear with improved shapes of the driven-side power transmission portions, in order to quickly performing molding machining relating to the flange driven-side power transmission portion.

Patent Reference 1: Japanese Patent Application Laid-open No. H8-328449 (Scope of Claims and similar)

Patent Reference 2: Japanese Patent Application Laid-open No. 2001-423845 (Scope of Claims and similar)

Patent Reference 3: U.S. Pat. No. 6,173,146 (Specification)

As described above, various studies relating to the structure of the driven-side power transmission portion of flanges have been made to date; but there is still a need for a flange with heightened practical applicability, achieved by increasing the rotational transmitted force during driving and improving the long-term reliability of the rotational precision, as well as improving cost-efficiency.

Further, because the direction of rotation of the driving-side power transmission portion of the device main body differs with the specifications of the device main body of the electrophotography application device, the shapes of the driving-side power transmission portion and of the driven-side power transmission portion must be changed according to the rotation direction. Hence a plurality of types of driven-side power transmission portions must be fabricated according to the shape of the driving-side power transmission portion, and there is a need for a driven-side power transmission portion which affords compatibility and is durable.

DISCLOSURE OF THE INVENTION

Hence an object of this invention is to provide an electrophotographic photoreceptor which has high rotational precision when used in actual equipment, and moreover which can maintain this rotational precision over the long term, and which further can transmit power regardless of the direction of rotation of the driving-side power transmission portion, and yet is excellent in terms of manufacturing cost.

In order to resolve the above-described problem, one mode of an electrophotographic photoreceptor of this invention is an electrophotographic photoreceptor which is removably installed and used in a device main unit of an electrophotography application device in a state of being built into a process cartridge. This electrophotographic photoreceptor comprises a photosensitive drum, configured from a cylindrical conductive base having an outer peripheral face formed with a photosensitive layer containing a photoconductive material, and a gear flange or a flange which is fitted to an end portion of the photosensitive drum and transmits, to the photosensitive drum, a rotational driving force from a driving-side power transmission portion disposed in the device main unit.

Further, the gear flange or flange is formed with a driven-side driving force transmission portion having a cylindrical member which is formed protruding on a face of the side receiving the rotational driving force and the center of which is a central axis of the photosensitive drum, and engaging protrusions which are disposed parallel to the central axis at trisecting positions on the outer periphery of the cylindrical member, each protruding in a radial direction and engaging the driving-side power transmission portion.

By means of one mode of the invention, a driven-side power transmission portion is formed comprising engaging protrusions in at least three places, disposed parallel to the central axis of the photosensitive drum. Hence the properties of installation into and fitting with the engaging hole formed in the driving-side power transmission portion of the engaging protrusions, as well as rotational precision and rotation intensity during printing, can be heightened regardless of the rotation direction, and moreover an electrophotographic photoreceptor which is excellent in terms of manufacturing cost can be realized.

BRIEF DESCRIPTION OF THE DRAWINGS

FIG. 2 shows the gear flange of one example of the invention, in which

FIG. 3 shows the gear flange of FIG. 2A, in which

FIG. 4 shows the gear flange of FIG. 2B, in which

BEST MODE FOR CARRYING OUT THE INVENTION

Below, embodiments of the invention are explained in detail.

Figure 1:
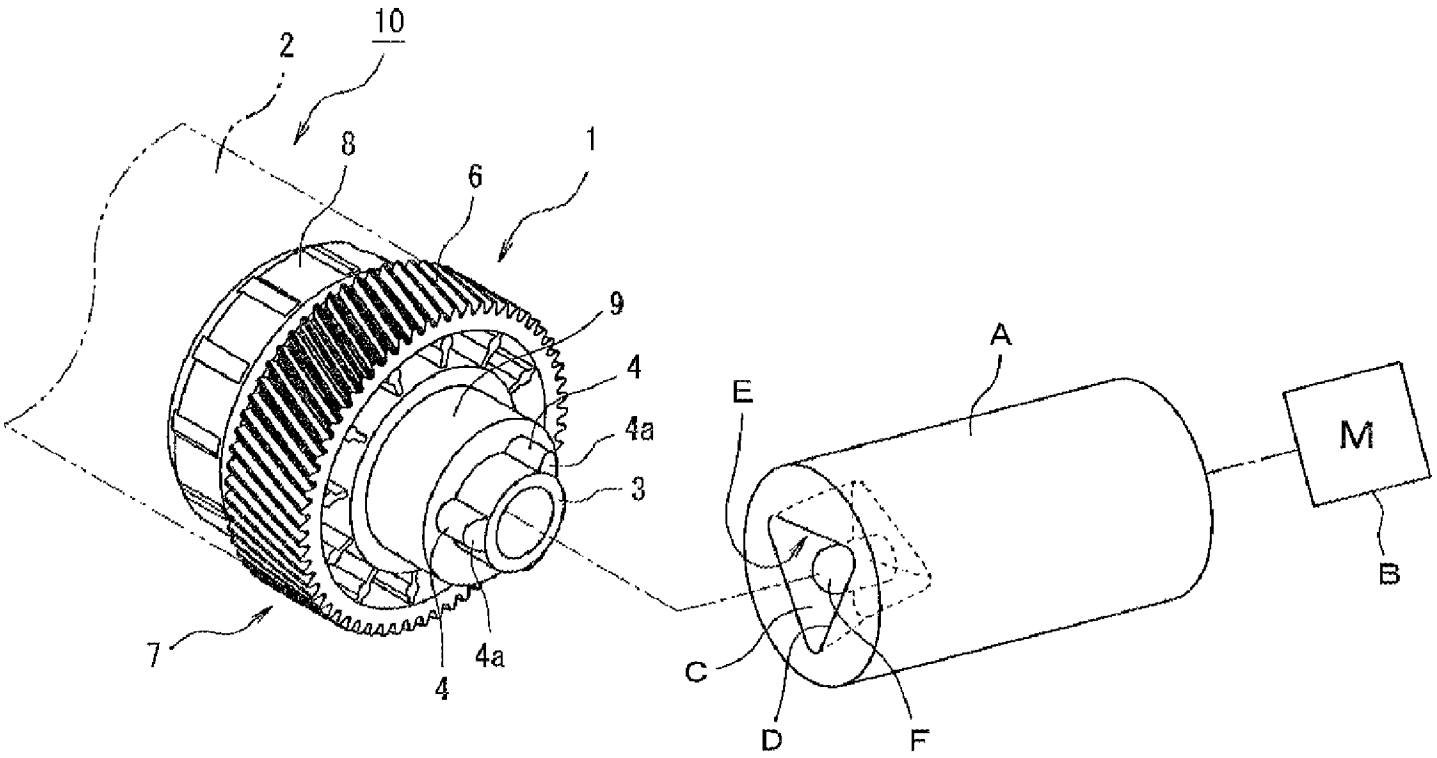
FIG. 1 is a partial expanded oblique view showing the electrophotographic photoreceptor, device driving shaft, and electric motor of one example of the invention.

FIG. 1 is a partially enlarged perspective view illustrating an electrophotographic photoreceptor, a device driving shaft, and an electric motor according to a first embodiment of the present invention. FIG. 2(*a*) is a perspective view of a gear flange shown in FIG. 1, and FIG. 2(*b*) is a perspective view of a variation of the gear flange.

The electrophotographic photoreceptor 10 of this invention is a photoreceptor for a process cartridge which is removably installed and used in a device main unit of an electrophotography application device in a state of being built into a process cartridge. As shown in the drawings, the photoreceptor 10 comprises a photosensitive drum 2 and a gear flange 1 fitted to an end portion opening thereof.

This gear flange 1 transmits rotational driving force from the device driving shaft A of the device main unit to the photosensitive drum 2, so that electrophotography processes are performed by the photosensitive drum 2. The device driving shaft A is conjoined with the rotation shaft of the electric motor B via a decelerating mechanism or other prescribed power transmission mechanism (not shown) and is driven in rotation in a fixed direction. On a tip face of this device driving shaft A is formed an engaging hole C forming a driving-side power transmission portion. This engaging hole C has a triangular opening portion D in an end face position of the device driving shaft A, and when connecting to this opening portion D the triangular cross-sectional shape is formed so as to rotate gradually in for example the counterclockwise direction as seen in FIG. 1 in moving to the rear end side of the device driving shaft A, to form a helically twisting engaging hole. Hence a helix-shape guiding face E is formed on the rear-face side of the opening portion D. The triangular opening portion D includes the substantially triangular opening portion, with R treatment performed at each of the three vertex portions.

In the electrophotographic photoreceptor 10, it is important that a driven-side power transmission portion 5 be formed on the face of the gear flange 1 on the side receiving rotational driving force. This driven-side power transmission portion 5 comprises a cylindrical member 3 centered on the central (rotating) axis of the photosensitive drum 2 in a shape protruding from the face of the gear flange 1 on the side receiving rotational driving force, and three engaging protrusions 4 disposed at trisecting positions on the outer peripheral face of this cylindrical member 3 as seen from the axis direction.

These engaging protrusions 4 are formed on the outer peripheral face of the cylindrical member 3, extending parallel to the central axis of the photosensitive drum 2 from the base side toward the tip face, as shown in FIG. 2. Transmission of rotational driving force from the driving-side power transmission portion is performed principally via these engaging protrusions 4. By forming the engaging protrusions 4 parallel to the central axis of the photosensitive drum 2, design of the gear flange 1 can be simplified, the gear flange 1 can be formed easily by injection molding or similar, and costs can be reduced. It is sufficient for there to be at least one engaging protrusion 4, and it is preferable that there be three engaging protrusions in the circumferential direction.

The gear flange 1 has a flange main unit 7 with a gear 6 formed on the outer peripheral portion. In this flange main unit 7 are formed a fitting portion 8 which fits into the opening end face of the photosensitive drum 2 on the rear side, and on the side opposite this fitting portion 8 with the gear 6 therebetween, a driven-side power transmission portion 5, comprising the cylindrical member 3 and engaging protrusions 4 described above, formed on the end face of a cylinder portion 9.

The external shape of the engaging protrusions 4 is substantially a semicircular column, as shown in FIG. 3B, 3C and FIGS. 4B-4D; by making the outer peripheral face a circular columnar face or similar, the cross section of the driving-side power transmission portion of the device main unit engages the opening portion D at the entrance to the triangular twisting engaging hole C, and strength with respect to rotation is secured during transmission of a driving force. So long as rotational driving force can be received, this shape of the engaging protrusions 4 is not limited to a substantially semicircular columnar shape as shown in the drawings, and for example a substantially triangular prism shape, or another appropriate shape can be used. Further, no particular limitations are imposed on the dimensions, which can be determined appropriately according to the dimensions of the gear flange 1 itself. The shape and dimensions may be designed so as to enable fitting with the driving force transmission portion of the device main unit.

Figure 3A:
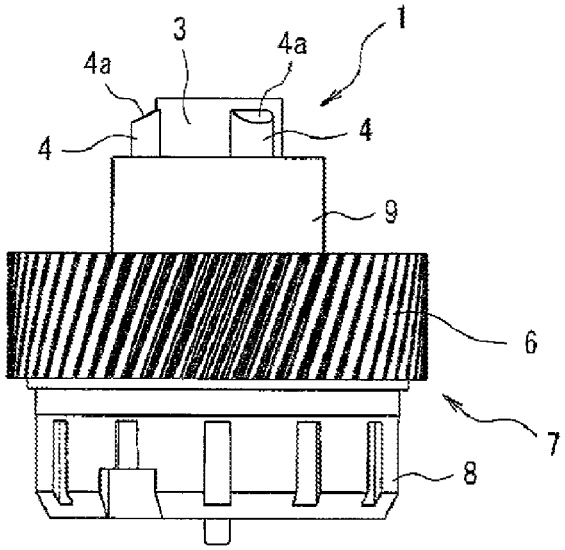
FIG. 3A is a side view.
Figure 3B:
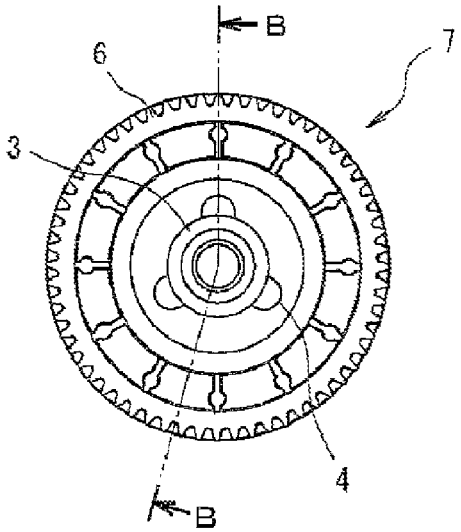
FIG. 3B is a front view.
Figure 3C:
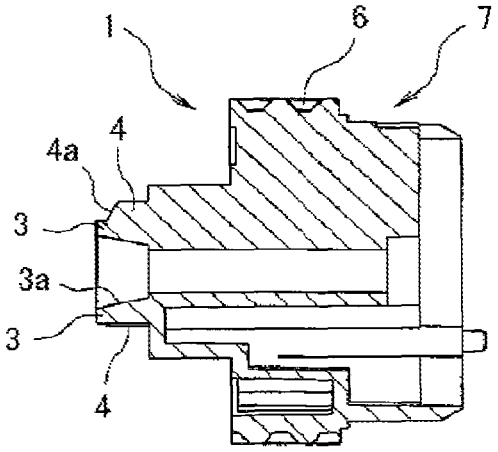
FIG. 3C is a cross-sectional view.
Figure 4A:
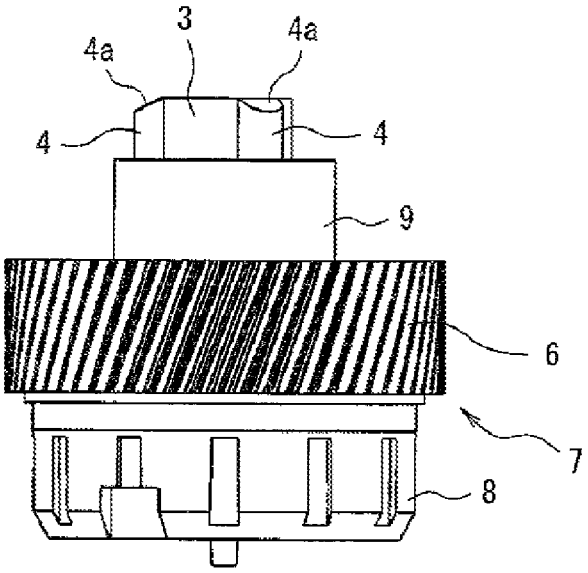
FIG. 4A is a side view.
Figure 4B:
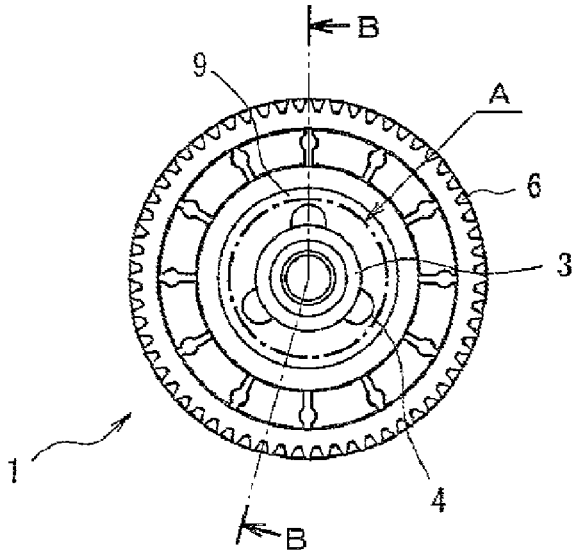
FIG. 4B is a front view.

The tip portions of the engaging protrusions 4 have inclined faces 4*a*, the protruding height of which relative to the driving-side power transmission portion declines in moving outward in the radial direction (see FIG. 3A and FIG. 4A). By providing these inclined faces 4*a*, even when the twisting engaging hole C with a triangular cross section formed in the tip face of the device driving shaft A serving as the driving-side power transmission portion does not match the positions of the engaging protrusions 4 engaging therewith, the inclined faces 4*a* of the end portions of the engaging protrusions 4 abut the entrance portion of the twisting engaging hole C, and fitting properties are improved. Thereafter, by causing the device driving shaft A to rotated by means of the electric motor B, when the central (rotating) axis of the driven-side power transmission portion 5 (the photosensitive drum 2) and the triangular axis center of the triangular twisting engaging hole C coincide, the device driving shaft A fits with the gear flange 1 while moving.

Figure 2A:
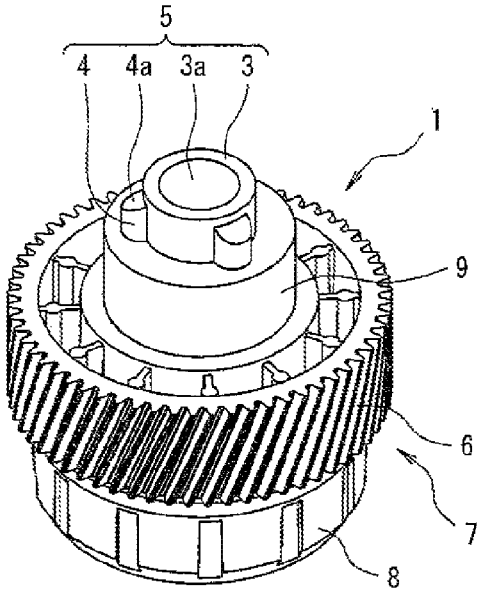
FIG. 2A is an oblique view of the gear flange shown in FIG. 1.
Figure 2B:
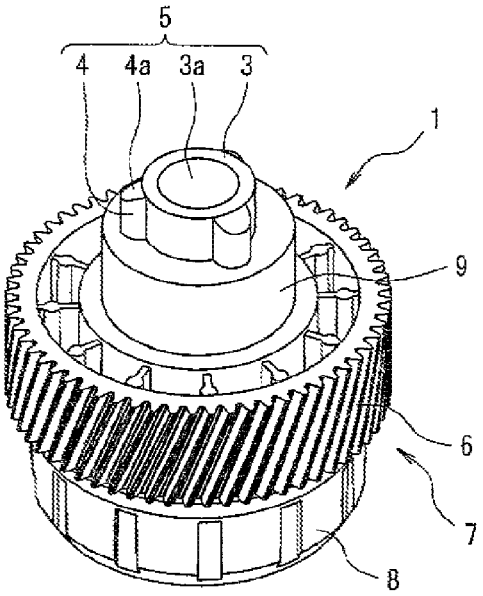
FIG. 2B is an oblique view showing a modified example of a gear flange, in which the engaging protrusions 4 are of the same height as the cylindrical member 3.

Further, the size of the engaging protrusions 4 relative to the cylindrical member 3 can be variously modified, as shown in FIGS. 2A and 2B. It is preferable that, as shown in FIG. 2A, the protruding height of the engaging protrusions 4 from the base portion of the cylindrical member 3 be made lower than the protruding height of the cylindrical member 3. By causing the end face of the cylindrical member 3 to protrude further toward the twisting engaging hole C than the tip portions 4*a*, the end face of the cylindrical member 3 comes into contact with the twisting engaging hole C before the tip portions 4*a* of the engaging protrusions 4 and the cylindrical member 3 is made concentric with the twisting engaging hole C, and moreover the cylindrical member 3 is inserted up to the floor portion of the triangular twisting engaging hole C and the end portion of the cylindrical member 3 is also supported, without the cross section formed in the base portion of the twisting engaging hole C being affected by the triangular twisting wall face.

Figure 5A:
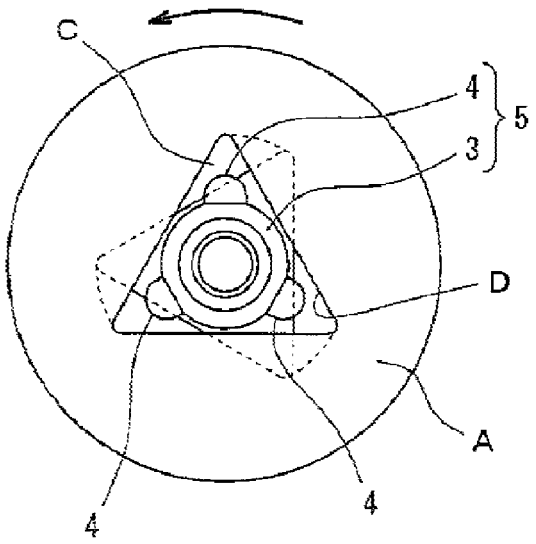
FIG. 5 is an explanatory diagram explaining operation in a first embodiment.
Figure 5B:
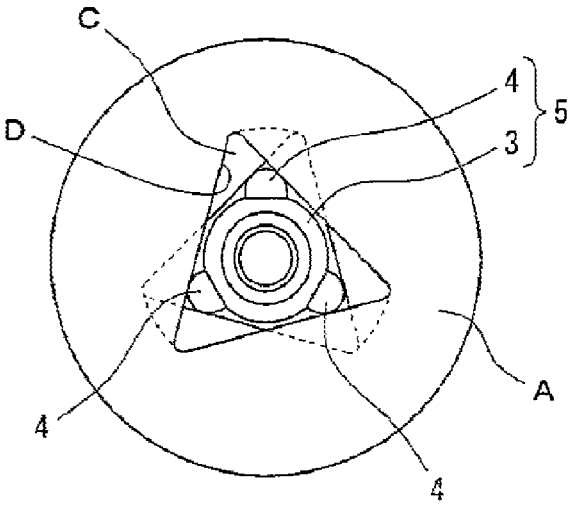

The operation of conjoining the gear flange 1 and the device driving shaft A is explained assuming that the triangular twisting engaging hole C formed in the device driving shaft A gradually twists in the clockwise direction in moving inward from the opening portion D, as shown in FIGS. 5A and 5B.

When installing in the device main unit of an electrophotography application device a process cartridge with an electrophotographic photoreceptor 10 built-in, first the device driving shaft A is made to rotate counterclockwise by the electro motor, and as shown in FIG. 5A, when the axis center of the driven-side power transmission portion 5 comprising the cylindrical member 3 and the engaging protrusions 4 coincides with the axis center of the triangular twisting engaging hole C formed in the tip of the device driving shaft A, the device driving shaft A begins joining of the two while moving to the side of the gear flange 1. At this time, because inclined faces 4*a* are formed on the tip sides of the engaging protrusions 4, insertion into the twisting engaging hole C of the driven-side power transmission portion 5 is easily performed.

Then, because the device driving shaft A is driven in rotation in the counterclockwise direction, the cylindrical member 3 and engaging protrusions 4 gradually are inserted toward the bottom portion of the twisting engaging hole C, according to the amount of twisting of the twisting engaging hole C. As shown in FIG. 5B, the outer peripheral faces of the base portion side of the engaging protrusions 4 abut the inner wall of the opening portion D of the twisting engaging hole C when the tip of the cylindrical member 3 reaches the bottom face of the twisting engaging hole C, or shortly therebefore, as shown in FIG. 5B. Hence the rotational driving force of the device driving shaft A is transmitted from the inner walls of the opening portion D of the twisting engaging hole C to the three engaging protrusions 4, and this transmitted rotational driving force is transmitted, via the cylindrical member 3, to the gear flange 1. From the gear flange 1, the rotational driving force is transmitted to the photosensitive drum 2 fitted thereinto.

In the state in which the outer peripheral faces on the base side of these engaging protrusions 4 are engaged with the peripheral wall of the opening portion D of the twisting engaging hole C, the tips of the engaging protrusions 4, that is, the inclined faces 4*a* are formed on the bottom portion side of the twisting engaging hole C, so that the inclined faces 4*a* do not make contact with the bottom portion of the twisting engaging hole C. Hence the transmission of rotational driving force from the device driving shaft A is performed only between the peripheral wall of the opening portion D of the twisting engaging hole C and the outer peripheral faces on the base side of the engaging protrusions 4. Consequently transmission of rotational driving force from the device driving shaft A to the gear flange 1 is performed reliably and without jitter.

Figure 5C:
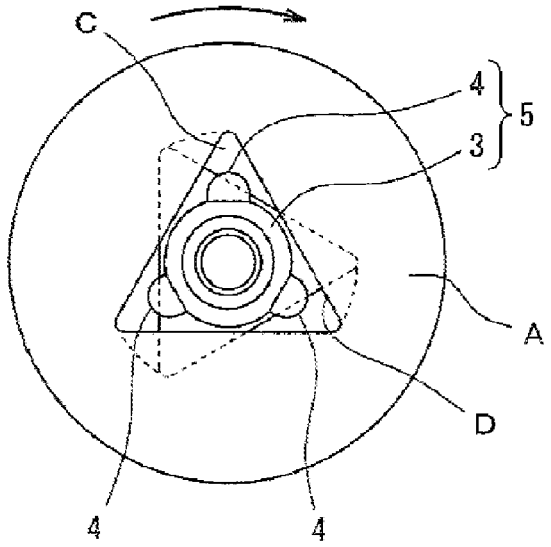
Figure 5D:
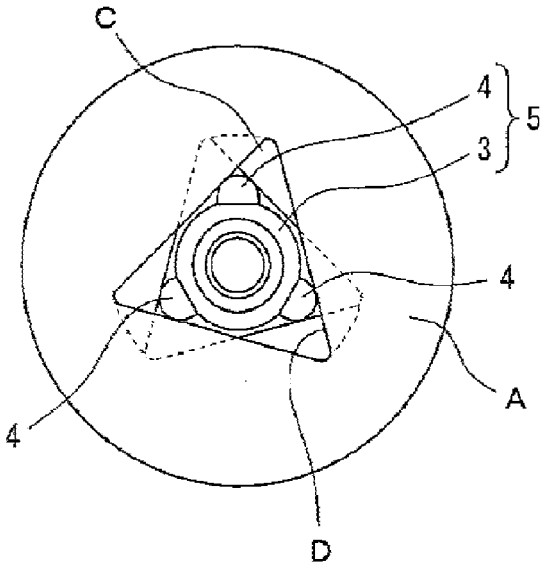

On the other hand, when the twisting direction of the twisting engaging hole C formed in the device driving shaft A is twisted in the counterclockwise direction in moving inward from the opening portion D, as shown in FIGS. 5C and 5D, the device driving shaft A performs rotational driving in the clockwise direction, as shown in FIG. 5C.

In this case, to join the twisting engaging hole C and the driven-side power transmission portion 5, as shown in FIG. 5C, when the axis center of the driven-side power transmission portion 5 comprising the cylindrical member 3 and the engaging protrusions 4 coincides with the axis center of the triangular twisting engaging hole C formed in the tip of the device driving shaft A, the device driving shaft A begins joining of the two while moving to the side of the gear flange 1. At this time, because inclined faces 4*a* are formed on the tip sides of the engaging protrusions 4, insertion into the twisting engaging hole C of the driven-side power transmission portion 5 is easily performed.

Then, because the device driving shaft A is driven in rotation in the clockwise direction, the cylindrical member 3 and engaging protrusions 4 gradually are inserted toward the bottom portion of the twisting engaging hole C, according to the amount of twisting of the twisting engaging hole C. As shown in FIG. 5D, the outer peripheral faces of the base portion side of the engaging protrusions 4 abut the inner wall of the opening portion D of the twisting engaging hole C when the tip of the cylindrical member 3 reaches the bottom face of the twisting engaging hole C, or shortly therebefore, as shown in FIG. 5D. Hence the rotational driving force of the device driving shaft A is transmitted from the inner walls of the opening portion D of the twisting engaging hole C to the three engaging protrusions 4, and this transmitted rotational driving force is transmitted, via the cylindrical member 3, to the gear flange 1. From the gear flange 1, the rotational driving force is transmitted to the photosensitive drum 2 fitted thereinto.

In this way, by means of the above-described first embodiment, the engaging protrusions 4 of the driven-side power transmission portion 5 can be reliably engaged with the twisting engaging hole C in both cases, when the twisting direction of the twisting engaging hole C of the device driving shaft A is twisted in the clockwise direction and the device driving shaft A drives rotation in the counterclockwise direction, and when the twisting direction of the twisting engaging hole C of the device driving shaft A is in the counterclockwise direction and the device driving shaft A drives rotation in the clockwise direction.

By appropriately selecting the relation between the shape of the engaging protrusions 4 and the inclination angle of the inclined faces 4*a*, the driving force transmission property and the guiding assistance property can be improved.

Figure 6:
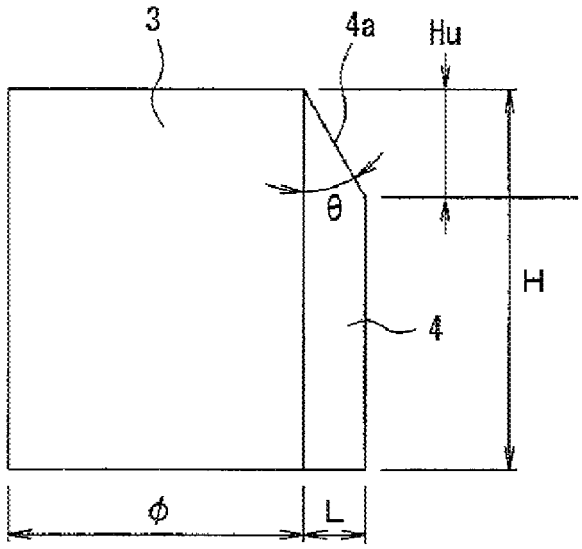
FIG. 6 is a schematic view showing the shapes of a cylindrical member and an engaging protrusion.

That is, as the shapes of the cylindrical member 3 and engaging protrusions 4, as shown in FIG. 6, if the protrusion length in the radial direction of the engaging protrusions 4 relative to the cylindrical member 3 is L, the protruding height in the axial direction from the base of the cylindrical member 3 is θ, the inclination angle of the inclined faces 4*a* is 8, and the height in the axial direction from the beginning of the inclined faces 4*a* to the portion connecting the inclined faces 4*a* and the cylindrical member 3 is Hu, then as a result of simulations for the following four Examples 1 to 4, the effective range of the inclination angle θ was confirmed. In the above-described simulations, the minimum necessary height at the outermost peripheral face of the engaging protrusions 4 (H-Hu) was set to 1.5 mm or greater. In FIG. 6, the height of the engaging protrusions 4 is equal to the height H of the cylindrical member 3.

No limitations in particular are imposed on the protrusion height H of the cylindrical member 3 (engaging protrusions 4); but in consideration of ease of engagement and disengagement and reliability of driving force transmission, a value of approximately 0.3 to 0.8 times the diameter ϕ of the cylindrical member 3 is desirable. If the protrusion height H is too large, ease of engagement/disengagement is greatly reduced, and if the protrusion height H is too small, disengaged spinning during rotation or disengagement may result. In order to enhance ease of engagement/disengagement, a protrusion height H for the engaging protrusions 4 of approximately ½ the diameter ϕ of the cylindrical member 3 is effective.

Example 1

The protrusion height H was set to 4.5 mm and the protrusion length L was set to 1.8 to 2.45 mm. In this Example 1, results for the guiding assistance property and driving force transmission characteristic of the inclined faces 4*a* when the inclination angle θ was varied are shown in FIG. 7.

Figure 7:
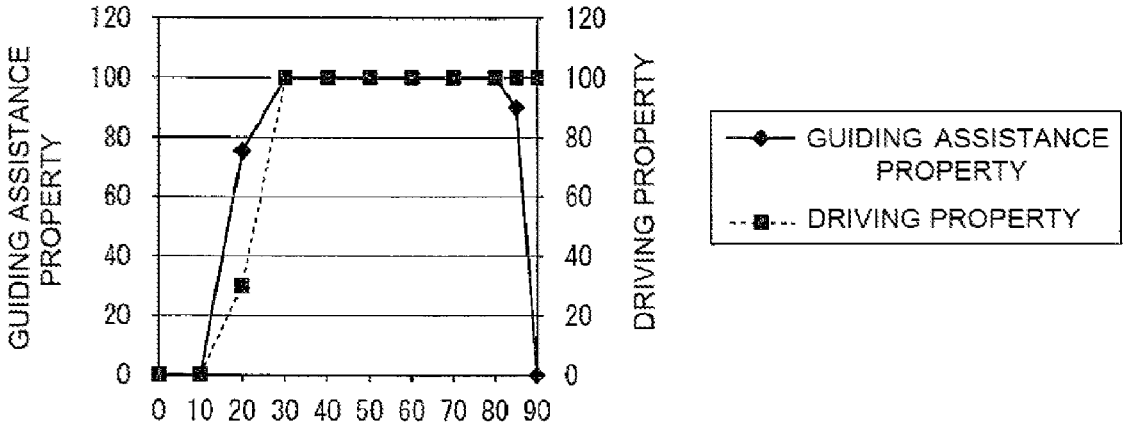
FIG. 7 is a graph showing the guiding assistance property and driving force transmission characteristic for the inclination angle θ in Example 1.

That is, the guiding assistance property and driving force transmission characteristic both reached 100% at an inclination angle θ of 31°, as indicated by the solid line and the dashed line in FIG. 7, and the guiding assistance property remained at 100% until an inclination angle θ of 78.5°. However, as indicated by the dashed line in FIG. 7, the driving force transmission characteristic remained at 100% up to an inclination angle of 90°. Hence in consideration of the guiding assistance characteristic, the effective inclination angle θa in Example 1 was set at 31° to 78.5°, and preferably the inclination angle θ was set at 60.9° to 67.8°.

Example 2

The protrusion height H was set to 3.0 mm and the protrusion length L was set to 2.58 to 3.13 mm. In this Example 2, results for the guiding assistance property and driving force transmission characteristic of the inclined faces 4*a* when the inclination angle θ was varied are shown in FIG. 8.

Figure 8:
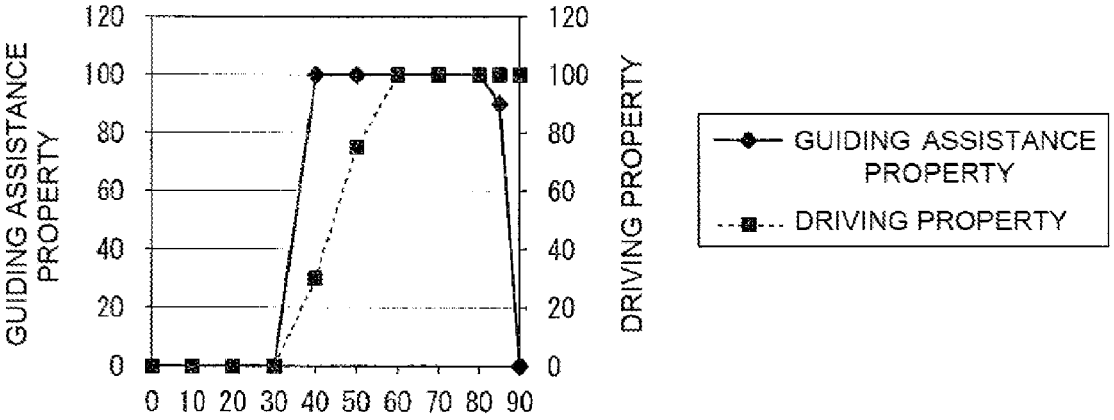
FIG. 8 is a graph showing the guiding assistance property and driving force transmission characteristic for the inclination angle θ in Example 2.

That is, as indicated by the solid line in FIG. 8, the guiding assistance characteristic reached 100% when the inclination angle θ was 40°, and remained at 100% until an inclination angle of 85°. On the other hand, as indicated by the dashed line in FIG. 8, the driving force transmission characteristic reached 100% at an inclination angle θ of 59.8°, and remained at 100% until an inclination angle θ of 90°. Hence in consideration of the guidance assistance characteristic and driving force transmission characteristic, the effective inclination angle θa in Example 2 was set at 59.8° to 85°, and preferably the inclination angle θ was set at 79° to 80.9°.

Example 3

The protrusion height H was set to 3.4 to 3.6 mm and the protrusion length L was set to 1.58 to 1.73 mm.

Figure 9:
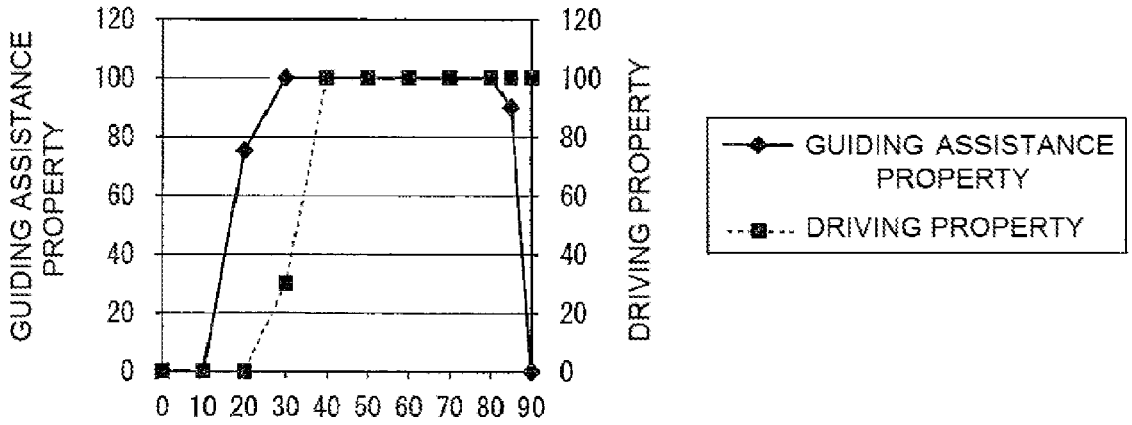
FIG. 9 is a graph showing the guiding assistance property and driving force transmission characteristic for the inclination angle θ in Example 3.

In this Example 3, results for the guiding assistance property and driving force transmission characteristic of the inclined faces 4*a* when the inclination angle θ was varied are shown in FIG. 9.

That is, as indicated by the solid line in FIG. 9, the guiding assistance characteristic reached 100% when the inclination angle θ was 30°, and remained at 100% until an inclination angle of 80°. On the other hand, as indicated by the dashed line in FIG. 9, the driving force transmission characteristic reached 100% at an inclination angle θ of 38.5°, and remained at 100% until an inclination angle θ of 90°. Hence in consideration of the guidance assistance characteristic and driving force transmission characteristic, the effective inclination angle θa in Example 3 was set at 38.5° to 80°, and preferably the inclination angle θ was set at 72.4° to 73.9°.

Example 4

The protrusion height H was set to 4.2 mm and the protrusion length L was set to 1.32 mm.

Figure 10:
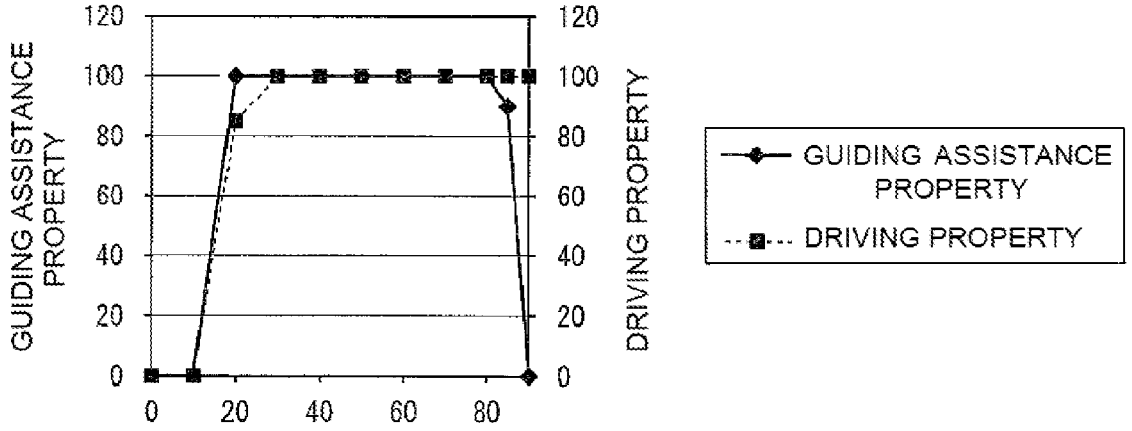
FIG. 10 is a graph showing the guiding assistance property and driving force transmission characteristic for the inclination angle θ in Example 4.
Figure 11A:
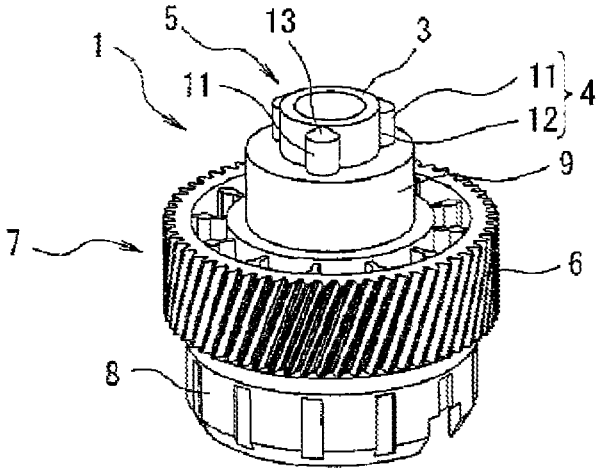
FIG. 11 shows the gear flange of a second embodiment of the invention.
Figure 11B:
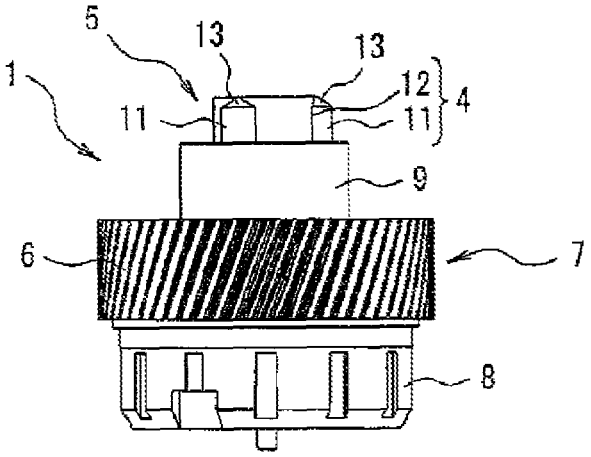
Figure 11C:
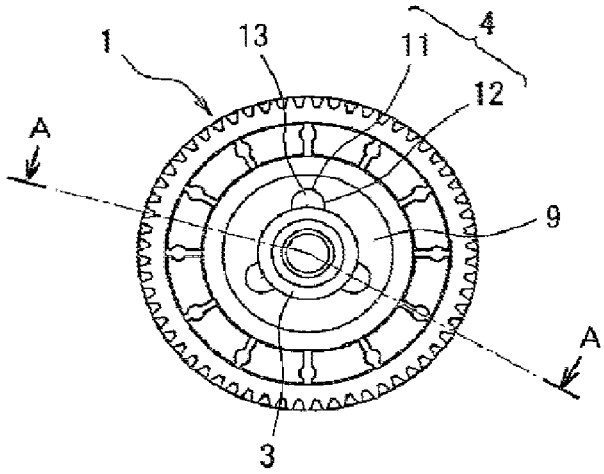
Figure 11D:
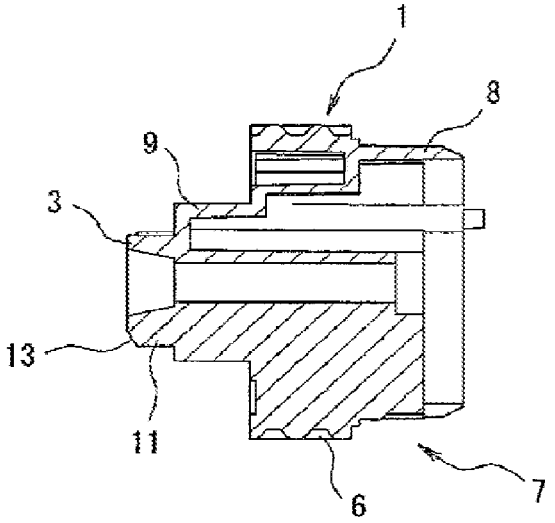

In this Example 4, results for the guiding assistance property and driving force transmission characteristic of the inclined faces 4*a* when the inclination angle θ was varied are shown in FIG. 10.

That is, as indicated by the solid line in FIG. 10, the guiding assistance characteristic reached 100% when the inclination angle θ was 20°, and remained at 100% until an inclination angle of 80°. On the other hand, as indicated by the dashed line in FIG. 10, the driving force transmission characteristic reached 100% at an inclination angle θ of 23.7°, and remained at 100% until an inclination angle θ of 90°. Hence in consideration of the guidance assistance characteristic and driving force transmission characteristic, the effective inclination angle θa in Example 4 was set at 23.7° to 80°, and preferably the inclination angle θ was set at 52.7°.

In this way, it was verified that by varying the inclination angle θ of the inclined faces 4*a* of the engaging protrusions 4 and the shapes of the engaging protrusions 4, the guiding assistance property and driving force transmission characteristic change. Hence in order to expand the freedom of selection of an effective inclination angle θa, it is preferable that Example 4 be selected.

On the other hand, in order not to make the inclination angle θ too large, and maintain a state near 90°, it is preferable that Example 2 be selected.

However, judging from the above-described Examples 1 to 4, by setting the inclination angle 8 to 85° or less, a guiding assistance characteristic of 100% can be secured, and so ease of insertion into the twisting engaging hole C of the driven-side power transmission portion 5 can be secured. Further, it is sufficient to set the inclination angle θ to 23.7° or higher to secure the driving force transmission characteristic. As a result, if the inclination angle θ is less than 23.7°, the guiding assistance property and driving force transmission characteristic cannot be secured even when the shape of the engaging protrusions 4 is changed, and if the inclination angle θ exceeds 85° the guiding assistance property can no longer be secured. Hence by setting the inclination angle θ of the inclined faces 4*a* of the engaging protrusions 4 in the range 23.7° to 85°, by selecting the shape of the engaging protrusions 4, it is possible to satisfy the requirements for both guiding assistance property and driving force transmission characteristic.

Further, when an alignment protrusion F is provided at the center of the bottom portion of the twisting engaging hole C, it is preferable that the shape of the inner peripheral face 3*a* of the cylindrical member 3 be made a cylindrical inner face shape so as to removably engage the alignment protrusion F. By making the shape of the inner peripheral face 3*a* of the cylindrical member 3 a cylindrical inner face shape, the engaging protrusions 4 can reliably transmit rotational driving force to the photosensitive drum 2 without the occurrence of center axial runout. That is, rotation precision is secured by causing the inner peripheral face 3*a* of the cylindrical member 3 to be engaged and aligned with the alignment protrusion F provided in the center of the bottom portion of the twisting engaging hole C of the above-described driving shaft A.

Figure 4C:
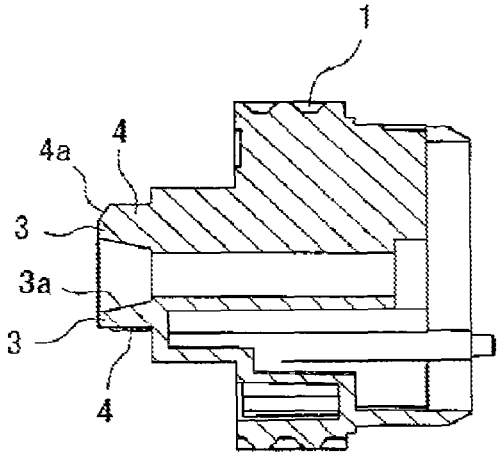
FIG. 4C is a cross-sectional view.
Figure 4D:
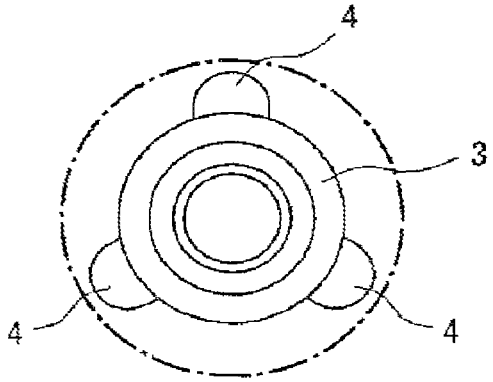
FIG. 4D is a partial expanded view.

As the shape of the inner peripheral face 3*a* of the cylindrical member 3, when the alignment protrusion F is a conical member or a truncated cone shape then as shown in FIG. 4C, by employing a mortar shape conforming to this shape, rotational precision can be further stabilized and improved.

In this invention, the desired effect can be obtained for the gear flange 1 if the above-described conditions are satisfied, and no limitations in particular are imposed on the material, structure, or other configuration parameters; for example, the following configuration can be used.

As the material of the gear flange 1, for example a polycarbonate, polyacetal, polyamide, polybutylene terephthalate, or various other general-use resin materials can be used; one type, or two or more types of these can be appropriately blended and used.

The photosensitive drum 2 comprises a cylindrical conductive base (hereafter also simply called "base"), on the outer peripheral face of which is formed a photosensitive layer containing a photoconductive material. In this invention, any materials which satisfy the characteristics required of a photoreceptor may be used as the materials of the base and photosensitive layer, and no limitations in particular are imposed. For example, as the base material, aluminum or an aluminum alloy or similar, or a cylindrical plastic member on the surface of which aluminum film has been evaporation-deposited, or similar can be used. And as the photoconductive material of the photosensitive layer, various phthalocyanine compounds or other well-known charge generation materials, and hydrazone compounds or other well-known charge transport materials, can each be used. Further, depending on the layer configuration, a charge transport material can be dispersed into or dissolved a binder together with other additives or similar, and a dipping application method or other well-known method can be used to form the photosensitive layer. The photosensitive layer may be a stacked film comprising a charge generation layer and a charge transport layer, or a single-layer film comprising a single layer; in addition, an undercoat layer may be provided between the base and the photosensitive layer.

Next, a second embodiment of the invention is explained referring to FIG. 11.

In this second embodiment, the tip shape of the above-described engaging protrusions 4 is modified from an inclined face.

That is, as shown in FIGS. 11A to 11D, in the second embodiment each of the engaging protrusions 4 formed on the outer peripheral face of the cylindrical member 3 comprises at least a semicircular columnar portion 11 having a semicircular cross-section, the center portion in the circular circumferential direction in a level plane forming a straight-line portion of the semicircular cross-sectional plane of which is in linear contact with the outer peripheral face of the cylindrical member 3, and a conjoining portion 12 connecting the circular circumferential-direction end portions in the level plane of this semicircular columnar portion 11 with the outer peripheral face of the cylindrical member 3. Further, each of the engaging protrusions 4 comprises a semicircular cone-shape tip portion. The tip portions of the engaging protrusions 4 have bottom faces which coincide with the end faces of the semicircular columnar portions 11, and form semicircular conical portions 13 serving as leading faces, the vertices of which coincide with the points of intersection of the lines of extension of lines of contact of the semicircular columnar portions 11 with the outer peripheral face of the cylindrical member 3 and the tip of the cylindrical member 3.

In this second embodiment, the tip shape of the engaging protrusions 4 is a semicircular conical shape, and thus at the tip face of the cylindrical member 3 the vertex of a semicircular conical portion 13 is in contact with the outer peripheral face of the cylindrical member 3, there is no portion protruding in the radial direction from the outer peripheral face of the cylindrical member 3, and in moving from this tip face of the cylindrical member 3 toward the base side, the conical face which is the outer peripheral face of the semicircular conical portion 13 gradually protrudes outward. Hence if the outer diameter of the cylindrical member 3 is set to be smaller than the inscribed circle of the opening portion D of the triangular twisting engaging hole C of the device driving shaft A, the tip of the cylindrical member 3 is reliably inserted into the opening portion D of the twisting engaging hole C.

Thereafter, by driving the device driving shaft A in rotation, the opening portion D of the twisting engaging hole C begins to rotate, and the cylindrical member 3 is inserted into the twisting engaging hole C. At this time, the circumscribed circle touching the semicircular conical portions 13 gradually grows larger, and thus the semicircular conical portions 13 are inserted into the twisting engaging circle C while being aligned. In this case, contact between the circular conical portions 13 and the opening portion of the twisting engaging hole C is point contact, and thus the circular conical portions 13 are smoothly inserted into the twisting engaging hole C with minimal resistance.

Then, when a state is entered in which the tip face of the cylindrical member 3 abuts the bottom portion of the twisting engaging hole C, the base sides of the engaging protrusions 4 are engaged with the opening portion of the twisting engaging hole C, the rotational force of the device driving shaft A is transmitted to the gear flange 1 via the engaging protrusions 4 and cylindrical member 3, and the photosensitive drum 2 is rotated.

In this way, by means of the above-described second embodiment, engagement of the twisting engaging hole C of the device driving shaft A and the driven-side power transmission portion 5 of the gear flange 1 can be performed smoothly, and when the tip face of the cylindrical member 3 abuts the bottom portion of the twisting engaging hole C, the semicircular columnar portions 11 of the engaging protrusions 4 engage the opening portion of the twisting engaging hole C, so that power can be transmitted with sufficient rotational strength.

Next, a third embodiment of the invention is explained referring to FIG. 12 to FIG. 14.

In this third embodiment, in place of a case in which the engaging protrusions 4 are extended in the central axis direction, engaging protrusions are partially formed.

Figure 12A:
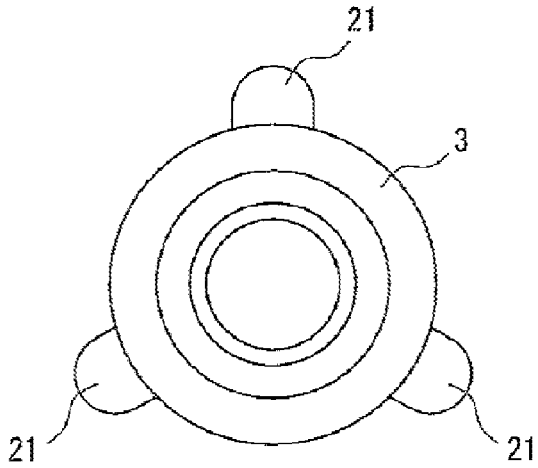
FIG. 12 is a plane view and expanded view showing a third embodiment of the invention.
Figure 12B:
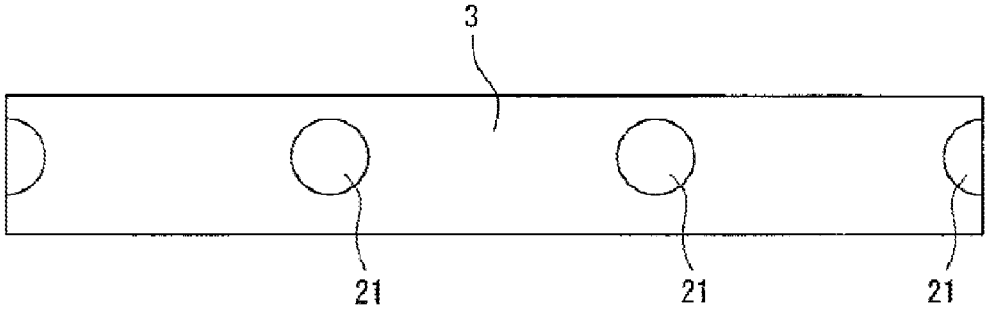

That is, in the third embodiment, the three engaging protrusions 4 comprise circular column members 22 with hemispherical portions 21 as tips in place of a semicircular columnar shape, as shown in FIGS. 12A and 12B. Here, the circular column members 22 are formed protruding in radial directions at positions on the outer peripheral face of the cylindrical member 3 which are slightly closer to the tip in the axis direction than the center portion. The circular column members 22 are positioned such that when the tip of the cylindrical member 3 abuts the bottom portion of the twisting engaging hole C formed in the device driving shaft A, one point of each of the hemispherical portions 21 of the circular columnar members 22 abuts the inner wall of the opening portion D of the twisting engaging hole C.

By means of this third embodiment, engaging protrusions are not formed on the tip side of the cylindrical member 3, so that by setting the outer diameter of the cylindrical member 3 to a smaller diameter than the inscribed circle of the triangular opening portion D of the twisting engaging hole C formed in the device driving shaft A, the cylindrical member 3 can easily be inserted into the triangular opening portion D of the twisting engaging hole C.

In this state, by rotationally driving the device driving shaft A using the electric motor B while pressing toward the cylindrical member 3, the tip of the cylindrical member 3 reaches the bottom portion of the twisting engaging hole C. At this time, the hemispherical portions 21 at the tips of each of the circular column members 22 are in point contact with the guiding face E inside the triangular opening portion D of the twisting engaging hole C while the cylindrical member 3 is inserted into the twisting engaging hole C, so that sliding resistance is reduced and the cylindrical member 3 can easily be inserted into the twisting engaging hole C. In addition, the tips of the circular column members 22 are inserted into the twisting engaging hole C, and thus a drawing-in effect can be exhibited.

And, in a state in which the tip of the cylindrical member 3 has reached the bottom portion of the twisting engaging hole C, the hemispherical portions 21 at the tips of each of the circular column members 22 maintain a state of point contact with the guiding face E on the rear-face side of the triangular opening portion D of the twisting engaging hole C. Consequently, the rotational driving force of the device driving shaft A is transmitted to the gear flange 1 via the driven-side power transmission portion 5, comprising the circular column members 22 and the cylindrical member 3, and the photosensitive drum 2 can be rotationally driven.

Figure 13A:
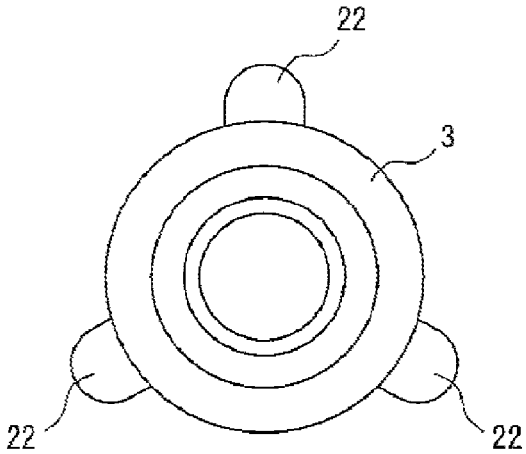
FIG. 13 is a plane view and expanded view showing a modified example of the third embodiment of the invention.
Figure 13B:
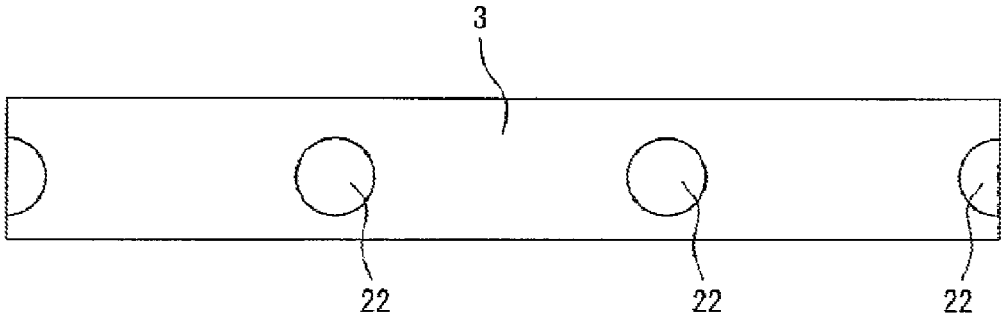

In the above-described third embodiment, a case was explained in which the circular column members 22 were disposed somewhat on the tip side of the center portion in the axial direction of the cylindrical member 3; but this position is not limited thereto, and as shown in FIGS. 13A and 13B, even when the circular column members 22 are formed on the base side of the cylindrical member 3, an action effect similar to that of the above-described third embodiment can be obtained.

In this case also, it is sufficient to form members such that, when the tip of the cylindrical member 3 abuts the bottom portion of the twisting engaging hole C formed in the device driving shaft A, the hemispherical portions 21 at the tips of the circular column members 22 make point contact with the inner wall of the triangular opening portion D of the twisting engaging hole C.

Figure 14A:
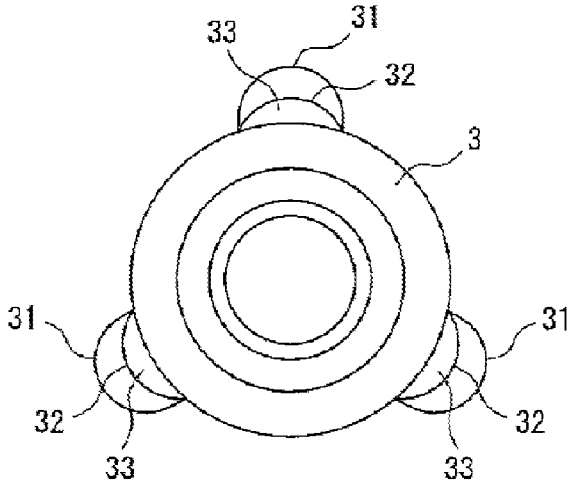
FIG. 14 is a plane view and expanded view showing another modified example of the third embodiment of the invention.
Figure 14B:
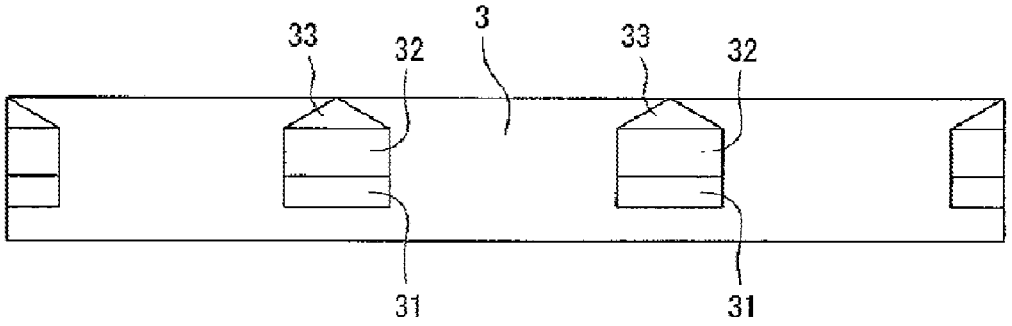

Further, in the above-described third embodiment, a case was explained in which circular column members 22 are applied as the engaging protrusions 4; but the configuration is not limited thereto, and a configuration such as in FIGS. 14A and 14B is also possible.

In the case of FIGS. 14 A and 14B, semicircular plate portions 31 formed protruding in radial directions on the base side of the cylindrical member 3, crescent-shape column portions 32 connected to the semicircular plate portions 31 at the base on the side of the cylindrical member 3 and the radial-direction protrusion amount of which is smaller than that of the semicircular plate portions 31, and semicircular conic portions 33 connected to the tips of these crescent-shape column portions 32 and similar to those of the above-described second embodiment, are comprised.

Here, the semicircular plate portions 31 are positioned such that when the cylindrical member 3 abuts the bottom portion of the twisting engaging hole C formed in the device driving shaft A, the outer peripheral faces make contact with the guiding face E on the rear side of the triangular opening portion D of the twisting engaging hole C.

In the configuration of FIGS. 14A and 14B also, during insertion of the cylindrical member 3 into the twisting engaging hole C, the diameter of the tip outer peripheral face of the cylindrical member 3 is the outer diameter of the cylindrical member itself, so that similarly to the above-described second embodiment, the cylindrical member 3 can easily be inserted into the opening portion D of the twisting engaging hole C.

Thereafter, until the tip of the cylindrical member 3 abuts the bottom portion of the twisting engaging hole C, the outer peripheral faces of the crescent-shape column portions 32 are inserted into the opening portion D of the twisting engaging hole C, and before the tip of the cylindrical member 3 reaches the bottom portion of the twisting engaging hole C, the outer peripheral faces of the semicircular plate portions 31 are in contact with the guiding face E on the rear side of the opening portion D of the twisting engaging hole C. Hence a draw-in effect is exhibited by means of the semicircular plate portions 31, and moreover the rotational driving force of the device driving shaft A is transmitted to the gear flange 1 via the driven-side power transmission portion 5, and the photosensitive drum 2 is rotated.

Next, a fourth embodiment of the invention is explained referring to FIG. 15.

In this fourth embodiment, as the engaging protrusions, protruding portions for torque transmission and protruding portions for drawing-in are provided.

Figure 15A:
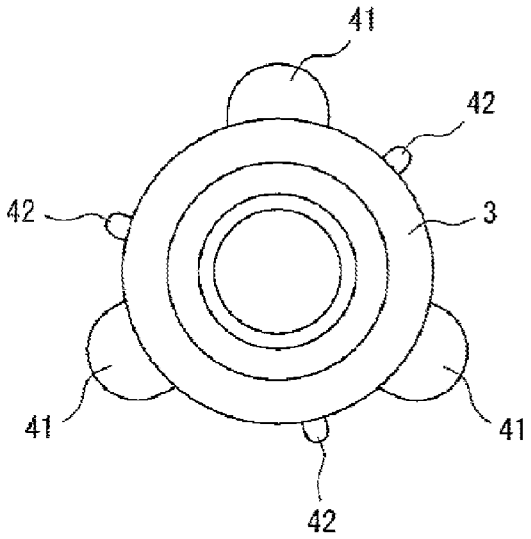
FIG. 15 is a plane view and expanded view showing a fourth embodiment of the invention.
Figure 15B:
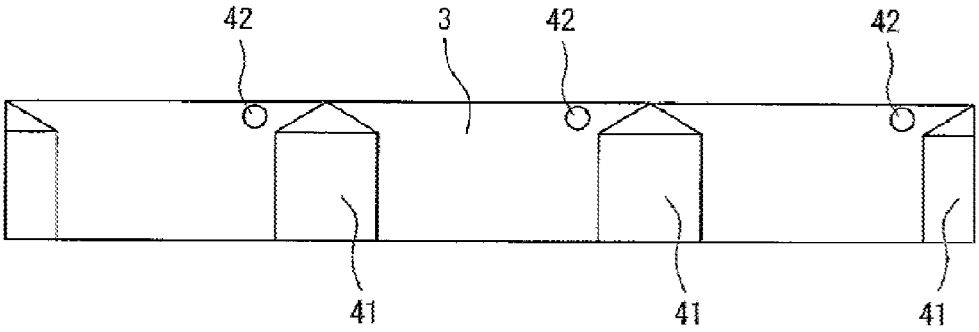

That is, in the fourth embodiment, as shown in FIGS. 15A and 15B, the three engaging protrusions 4 in the configuration of the above-described second embodiment are replaced with three protruding portions for torque transmission 41, and protruding portions for drawing-in 42 comprising circular column portions formed with tips in a hemispherical shape are formed between the protruding portions for torque transmission 41 on the tip sides of these three protruding portions for torque transmission 41.

The protruding portions for drawing-in 42 engage the guiding face E on the rear-face side of the triangular opening portion D of the twisting engaging hole C formed in the device driving shaft A, and perform an action of drawing in the cylindrical member 3 on the bottom side of the twisting hole C accompanying rotation of the device driving shaft A. These protruding portions for drawing-in 42 perform only the action of drawing in the cylindrical member 3 on the bottom side of the twisting hole C, and thus it is preferable that these protruding portions for drawing-in 42 be formed to be comparatively narrow, so as to provide flexibility.

Figure 16A:
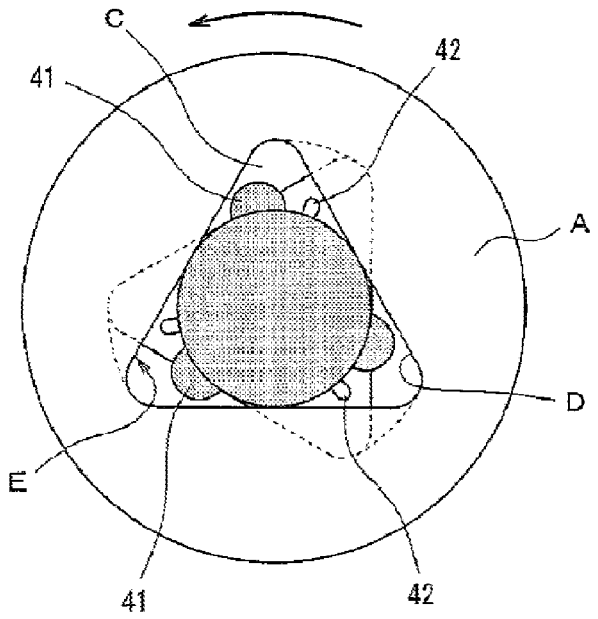
FIG. 16 is an explanatory diagram explaining operation in the fourth embodiment.

By means of this fourth embodiment, when the gear flange 1 is conjoined with the device driving shaft A, first, as shown in FIG. 16A, the cylindrical member 3 and the protruding portions for drawing-in 42 are inserted into the opening portion D of the twisting engaging hole C formed in the end face of the device driving shaft A. In this state, the electric motor B is driven in rotation, and the device driving shaft A is rotated counterclockwise in FIG. 16A, upon which the protruding portions for drawing-in 42 are guided by the spiral guiding face on the rear side of the opening portion D of the twisting engaging hole C, and the cylindrical member 3 is drawn into the twisting engaging hole C.

Figure 16B:
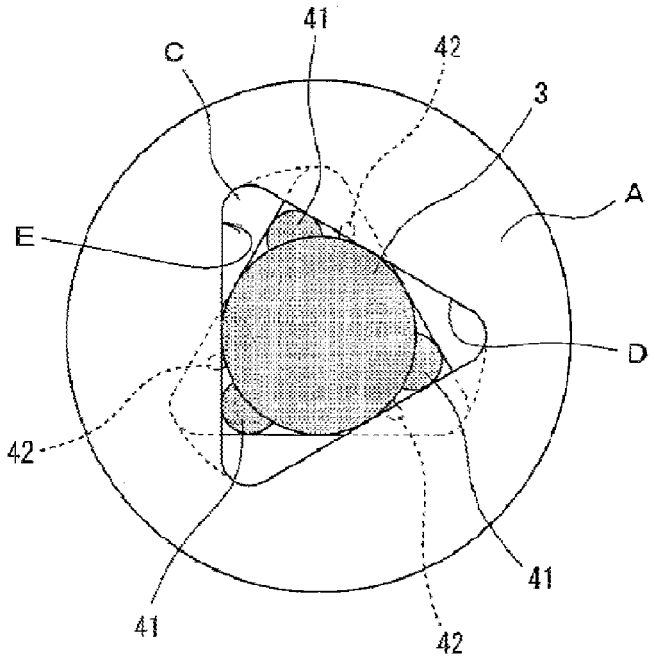

Consequently, as shown in FIG. 16B, the cylindrical member 3 is drawn into the twisting engaging hole C until the tip abuts the bottom of the twisting engaging hole C and the protruding portions for torque transmission 41 make contact with the inner wall of the opening portion D of the twisting engaging hole C. When the protruding portions for torque transmission 41 enter a state of contact with the inner wall of the opening portion D of the twisting engaging hole C the rotational driving force of the device driving shaft A is transmitted to the gear flange 1 via the protruding portions for torque transmission 41 and the cylindrical member 3, and the photosensitive drum 2 is driven in rotation.

Thus by means of the fourth embodiment, engaging protrusions comprise protruding portions for torque transmission 41 and protruding portions for drawing-in 42. Hence through guiding of the protruding portions for drawing-in 42 by the guiding face of the inner face of the twisting engaging hole C, the cylindrical member 3 is reliably drawn in until the tip thereof abuts the bottom of the twisting engaging hole C. Hence a situation in which the depth of engagement of the twisting engaging hole C and the cylindrical member 3 is insufficient can be reliably prevented, and the occurrence of disengaged spinning or jitter of the device driving shaft A and driven-side power transmission portion 5, and instability in rotation precision, can be reliably prevented.

In the above-described fourth embodiment, a case was explained in which the protruding portions for drawing-in 42 are provided on the clockwise-direction side of the protruding portions for torque transmission 41; in a case in which the direction of rotation of the device driving shaft A is opposite, the protruding portions for drawing-in 42 may be provided on the counterclockwise direction side of the protruding portions for torque transmission 41. Further, protruding portions for drawing-in 42 may be provided on both the clockwise direction and counterclockwise direction sides of the protruding portions for torque transmission 41, and in this case, different twisting directions of the twisting engaging hole C can be accommodated regardless of whether the rotation direction of the device driving shaft A is clockwise direction rotation or counterclockwise direction rotation.

Figure 17A:
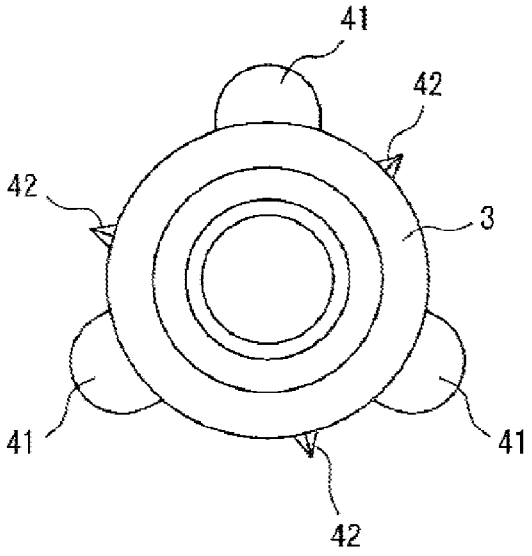
FIG. 17 is a plane view and expanded view showing a modified example of the fourth embodiment of the invention.
Figure 17B:
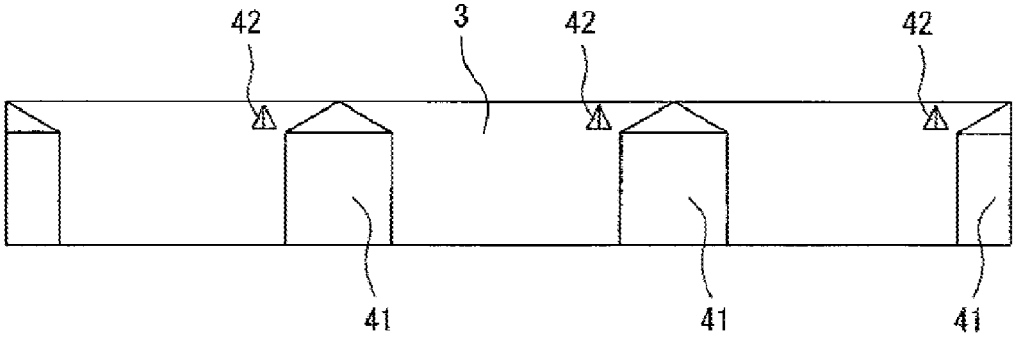
Figure 18A:
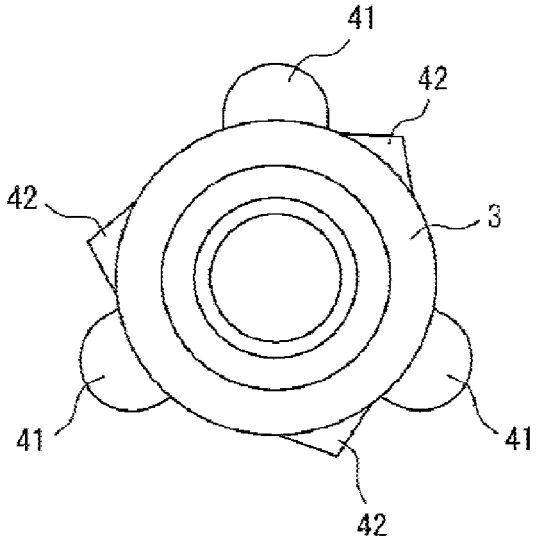
FIG. 18 is a plane view and expanded view showing another modified example of the fourth embodiment of the invention.
Figure 18B:
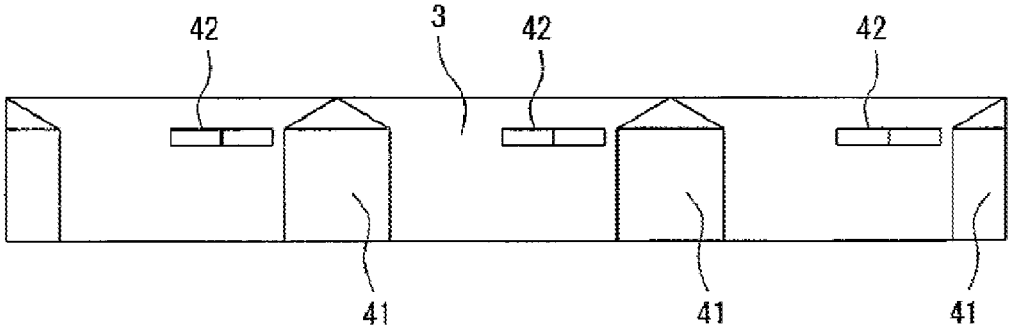

Further, in the above-described fourth embodiment, a case was explained in which the protruding portions for drawing-in 42 are circular columnar shape; but as shown in FIGS. 17A and 17B, the protruding portions for drawing-in 42 may be triangular prism shape, or, as shown in FIGS. 18A and 18B, may be formed in a triangular plate shape. In essence, any arbitrary shape may be applied to the protruding portions for drawing-in 42, so long as the shape enables guiding by the guiding face of the twisting engaging hole C.

Figure 19:
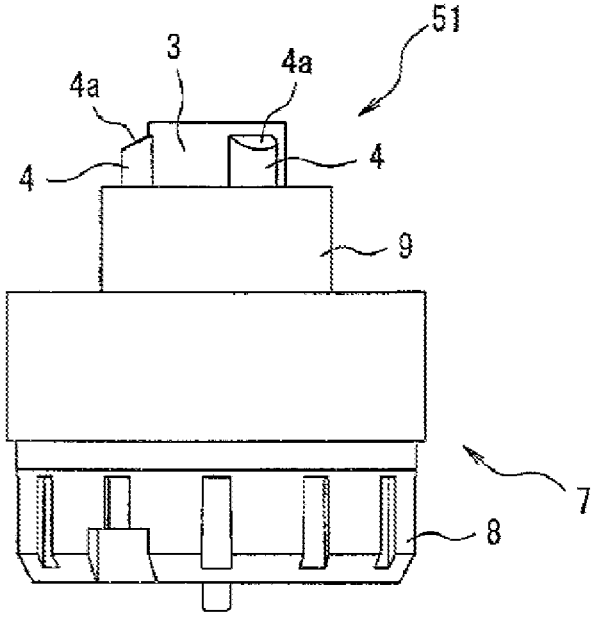
FIG. 19 is a plane view and front view showing a flange with the gear omitted to which this invention can be applied.

The above-described embodiments present specific examples of the invention, but the invention is not limited to these embodiments, and various modifications are of course possible without deviating from the gist of the invention. In the above-described first through fourth embodiments, gear flanges 1 in which a gear 6 is formed on the outer peripheral portion of a flange main unit 7 were explained; but this invention can also be applied to a flange 51 in which a flange main unit 7, on which a gear is not formed, comprises a driven-side power transmission portion 5, as shown in FIG. 19. In this case also, advantageous effects of action similar to those of the gear flanges 1 of the above-described first through fourth embodiments are exhibited.

INDUSTRIAL APPLICABILITY

By means of this invention, an electrophotographic photoreceptor is provided which has high rotational precision when used in actual equipment, and moreover which can maintain this rotational precision over the long term, and which further can transmit power regardless of the direction of rotation of the driving-side power transmission portion, and yet is excellent in terms of manufacturing cost.

The invention claimed is:

1. An electrophotographic photoreceptor, which is removably installed and used in a device main unit of an electrophotography application device so as to form a process cartridge, the device main unit including a driving-side power transmission portion, the electrophotographic photoreceptor comprising:

a photosensitive drum including a cylindrical conductive base having an outer peripheral face that has a photosensitive layer containing a photoconductive material; and a flange, which is fitted to an end portion of the photosensitive drum, including a driven-side driving force transmission portion, the flange for transmitting with the driven-side driving force transmission portion a rotational driving force from the driving-side power transmission portion to the photosensitive drum, the driven-side driving force transmission portion having a cylindrical member protruding from a face of the flange that is disposed on a side of the flange to receive the rotational driving force, a center of the cylindrical member being disposed on a central axis of the photosensitive drum, and engaging protrusions which are disposed parallel to the central axis at positions on an outer periphery of the cylindrical member that trisect the cylindrical member, each protrusion protruding in a radial direction to engage the driving-side power transmission portion, each protrusion further having a tip end that is a semicircular conical projection.

2. The electrophotographic photoreceptor according to claim 1, wherein the engaging protrusions are configured to engage an engaging hole disposed in a center portion of the driving-side power transmission portion, the engaging hole having a triangular cross-section, and the engaging protrusions receiving the rotational driving force from the driving-side power transmission portion to cause rotation of the photosensitive drum.

3. The electrophotographic photoreceptor according to claim 1, wherein the engaging protrusions are configured to engage a twisting engaging hole provided in a center portion of the driving-side power transmission portion, the engaging hole having a triangular cross-section, and the engaging protrusions receiving the rotational driving force from the driving-side power transmission portion to cause rotation of the photosensitive drum.

4. The electrophotographic photoreceptor according to claim 3, wherein the engaging protrusions extend in an axial direction of the cylindrical member along an outer peripheral face of the cylindrical member.

5. The electrophotographic photoreceptor according to claim 4, wherein a length of each of the engaging protrusions, which is a length between opposite ends of the respective engaging protrusion along the axial direction, is less than a length of the cylindrical member between opposite ends thereof along the axial direction, such that a tip of the cylindrical member is able to reach a bottom face of the engaging hole of the driving-side power transmission portion.

6. The electrophotographic photoreceptor according to claim 3, wherein the driving-side power transmission portion includes a protrusion for alignment provided in the center portion and in the engaging hole, an inner peripheral face of the cylindrical member being formed in a shape to enable engagement with an outer peripheral face of the protrusion of the driving-side power transmission portion.

7. The electrophotographic photoreceptor according to claim 6, wherein the protrusion of the driving-side power transmission portion has a truncated conical shape, and the inner peripheral face of the cylindrical member has a mortar shape which is configured to engage the truncated conical shape.

8. The electrophotographic photoreceptor according to claim 3, wherein the engaging protrusions each include a first protruding portion, for torque transmission, which is configured to engage an entrance side of the twisting engaging hole, and a second protruding portion, for drawing-in the driven-side driving force transmission portion, which is configured to engage a guiding face of the twisting engaging hole.

9. The electrophotographic photoreceptor according to claim 8, wherein the first protruding portions are formed on a base side of the cylindrical member, and the second protruding portions are formed on a tip side of the cylindrical member that is opposite the base side.

10. The electrophotographic photoreceptor according to claim 9, wherein the first protruding portions are circular column members the tips of which are hemispherical in shape.

11. The electrophotographic photoreceptor according to claim 9, wherein the second protruding portions are circular column protrusions disposed between the first protruding portions.

12. The electrophotographic photoreceptor according to claim 9, wherein the second protruding portions are triangular prism protrusions disposed between the first protruding portions.

13. The electrophotographic photoreceptor according to claim 9, wherein the second protruding portions are triangular plate protrusions disposed between the first protruding portions.

14. The electrophotographic photoreceptor according to claim 3, wherein an outer diameter of the cylindrical member is set to be smaller than a diameter of an inscribed circle of the engaging hole.

15. The electrophotographic photoreceptor according to claim 1, wherein the flange is a gear flange.

16. The electrophotographic photoreceptor according to claim 1, wherein the tip ends have vertices which are at a leading face of the cylindrical member, the tip ends being adapted to be inserted into an engaging hole disposed in a center portion of the driving-side power transmission portion before any other part of the engaging protrusions.

17. An electrophotography application device comprising:

a device main unit including a driving-side power transmission portion that has a twisting engaging hole provided in a center portion of the driving-side power transmission portion, the twisting engaging hole having a triangular cross-section, the twisting engaging hole helically twisting so that the triangular cross-section twists along an axial direction of the driving-side power transmission portion;

an electrophotographic photoreceptor removably installed in the driving-side power transmission portion so as to form a process cartridge, the electrophotographic photoreceptor including:

a photosensitive drum including a cylindrical conductive base having an outer peripheral face that has a photosensitive layer containing a photoconductive material; and a flange, which is fitted to an end portion of the photosensitive drum, including a driven-side driving force transmission portion, the flange transmitting, with the driven-side driving force transmission portion, a rotational driving force from the driving-side power transmission portion to the photosensitive drum, the driven-side driving force transmission portion having a cylindrical member protruding from a face of the flange that is disposed on a side of the flange that receives the rotational driving force, a center of the cylindrical member being disposed on a central axis of the photosensitive drum, and engaging protrusions which are disposed parallel to the central axis at positions on an outer periphery of the cylindrical member that trisect the cylindrical member, each protrusion protruding in a radial direction and engaging the driving-side power transmission portion, the engaging protrusions engaging the twisting engaging hole, the engaging protrusions being adapted to receive the rotational driving force from the driving-side power transmission portion to cause rotation of the photosensitive drum.

18. The electrophotographic photoreceptor according to claim 17, wherein each of the engaging protrusions includes a tip portion that has an inclined face so as to facilitate insertion of the driven-side driving force transmission portion into the engaging hole, and a protrusion height of the tip portion, that is a distance that the tip portion is disposed from the driving-side power transmission portion, decreasing along an axial direction of the cylindrical member.

19. The electrophotographic photoreceptor according to claim 17, wherein tip portions of the engaging protrusions are respectively provided with conical-shape inclined faces, which facilitate insertion of the driven-side driving force transmission portion into the engaging hole.

20. An electrophotographic photoreceptor, which is removably installed and used in a device main unit of an electrophotography application device so as to form a process cartridge, the device main unit including a driving-side power transmission portion having an engaging hole, the electrophotographic photoreceptor comprising:

a photosensitive drum including a cylindrical conductive base having an outer peripheral face that has a photosensitive layer containing a photoconductive material; and a flange, which is fitted to an end portion of the photosensitive drum, including a driven-side driving force transmission portion, the flange for transmitting, with the driven-side driving force transmission portion, a rotational driving force from the driving-side power transmission portion to the photosensitive drum, the driven-side driving force transmission portion having a cylindrical member protruding from a face of the flange that is disposed on a side of the flange to receive the rotational driving force, a center of the cylindrical member being disposed on a central axis of the photosensitive drum, and engaging protrusions which are disposed parallel to the central axis at positions on an outer periphery of the cylindrical member that trisect the cylindrical member, each protrusion protruding in a radial direction to engage the driving-side power transmission portion, the engaging protrusions each including a first protruding portion, for torque transmission, to engage an entrance side of the engaging hole, and a second protruding portion, for drawing-in the driven-side driving force transmission portion into the engaging hole, to engage a guiding face of the engaging hole, the first and second protruding portions being different shapes from each other and free of contact with each other.

* * * * *